United States Patent [19]

Cardenes Armas

[11] 3,938,933

[45] Feb. 17, 1976

[54] FUEL OIL BURNING METHOD

[76] Inventor: Gregorio Cardenes Armas, Las Palmas (Canary Islands) Paraguay, 7, Spain

[22] Filed: June 11, 1973

[21] Appl. No.: 368,582

[52] U.S. Cl. ..... 431/4; 431/11; 210/187

[51] Int. Cl.[2] ..... F23J 7/00

[58] Field of Search ..... 210/187; 431/4, 11

[56] References Cited

UNITED STATES PATENTS

| | | | |
|---|---|---|---|
| 2,033,010 | 3/1936 | Russell | 431/4 |
| 2,104,311 | 1/1938 | Russell | 431/4 |
| 2,732,070 | 5/1956 | Glasgow et al. | 210/187 |
| 3,589,314 | 6/1971 | Tratz et al. | 431/11 X |
| 3,741,712 | 6/1973 | Delatronchette | 431/4 X |
| 3,749,318 | 7/1973 | Cottell | 43/4 UX |
| 3,766,942 | 10/1973 | Delatronchette et al. | 431/4 X |

*Primary Examiner*—Charles J. Myhre
*Assistant Examiner*—W. C. Anderson
*Attorney, Agent, or Firm*—Wenderoth, Lind & Ponack

[57] ABSTRACT

Heated fuel-oil is injected into an open-ended mixing chamber simultaneously with a jet of water so that an intimate mixture of fuel-oil and water is formed. This mixture is ignited and sufficient air is supplied to support combustion. To clean and pre-heat the fuel, it is injected into a tank partly filled with hot water, through which the oil rises to form a separate layer in the top of the tank, from where it is withdrawn.

4 Claims, 4 Drawing Figures

FUEL OIL BURNING METHOD

BACKGROUND OF THE INVENTION

The present invention relates to improvements in the operation of burners and gasifiers for mixtures of water and hydrocarbons. An assembly is described which consists of a device to filter and preheat the fuel-oil by passing it through heated water, which device is connected to one or more burners.

The burner which is described operates on the principle that if in a container isolated from the air there is a quantity of any hydrocarbon, preferably a heavy hydrocarbon, and it is heated with an indirect flame to above the boiling point, the hydrocarbon tends to vaporise rapidly. But if at the time there is added a quantity of water, a little less than the volume of the hydrocarbon, and the heat is sufficient so that the water vapour does not cool the mixture, there results from this a combination forming a gas with a high calorific value. It has been shown that the hydrogen of the water combines with the carbon surplus to the combustion, which is of importance in possible industrial applications, all the more so when it is realized that the mixture burns completely without smoke.

If concerned with combustion of a combustible liquid, it must be taken into account that such substances do not burn in this liquid state but that the vapour formed from them burns and the heat liberated thereby ensures that more liquid is evaporated in the combustion zone, and the new vapour maintains the combustion.

Firstly, as may be expected, atoms of hydrogen are formed which react with the molecules of oxygen coming from the air for combustion, forming OH radicals which react in their turn with a molecule of atomic hydrogen, which repeats the process.

In this way, one single atom of hydrogen can form a new atom of the same kind, which sets up a chain reaction process.

To sum up, there is a combustion in which previously there takes place the phenomenon of break up of the fuel-oil and furthermore, with reaction with molecules of water, and in the hollow of the flame a supply of oxygen proceeds from the split water and the OH radicals. The combustion is then rich in hydrogen and oxygen.

A physical aspect of this process of novel combustion is that the particles of water vapour in emulsion with oil, atomise the oil, and in fact an aerosol is formed by the emulsion, which helps combustion.

In fact, the emulsion with the help of the water vapour allows an increase in the partial pressure of the water vapour, with which the energy emitted (linked directly with this partial pressure) increases, in relation to the carbonic anhydride being unatomised by the water. This allows improvement of the transference of heat by radiation (logical increase in the radiation-convection relationship, which is the present concern).

In a thermo-chemical aspect the atoms of carbon of the oil react with the water with a formation of carbon monoxide, diminishing rapidly all possible presence of unburnt particles, the presence of molecules of water already being able to exercise a weakening action on the cracking process of the fuel, so as to avoid the production of soot (last step of the cracking) and thus of unburnt particles.

At the moment of the "slow explosion" (flame) and with the increase of the temperature, there appear short-lived molecular fragments (free radicals, complex and active particles), which rapidly combine in the less heated zones. The presence of emulsified oil in the case considered favours this fact and furthermore it must be taken into account that the atoms of hydrogen favour the increase of velocity of the flame.

This formation of gaseous compounds, methane, ethane, butane, propane, etc., ensures that the combustion is, partly a combustion of gases, very different from the normal aerosol liquid.

SUMMARY OF THE INVENTION

The invention provides a method of burning fuel oil comprising filtering the fuel oil and preheating it to approximately 90°C by passing the fuel-oil through water to free the fuel-oil from pockets and particles of water, passing the preheated fuel oil, free from particles and pockets of water, to a burner assembly, heating the fuel-oil to approximately 300°C in the burner assembly, and ejecting the hot fuel-oil from the assembly simultaneously with a jet of water which mixes with the fuel-oil.

The invention also provides apparatus for burning fuel-oil, comprising a water tank, means for heating water in the tank, means for injecting fuel-oil into the tank so that the fuel-oil rises through the hot water to form a layer in the top of the tank, an open-ended mixing chamber for fuel-oil and water, a fuel-oil line communicating between the top of the tank and the mixing chamber, the fuel-oil line including a heater and a pump, means for injecting a jet of water into the mixing chamber to form an intimate mixture of fuel-oil and water, and means for supplying to the open end of the mixing chamber sufficient air to support combustion of the mixture.

In a preferred embodiment, a device which forms the filter and preheater for the fuel-oil is formed by a vertical tank for water, which contains a combustion chamber, with a burner at one end formed by an atomiser and pump, and at the opposite end communicates with a gas outlet flue. Above this chamber is disposed a container receiving the fuel-oil which rises to the surface of the water.

Furthermore, the water tank has a transparent tube which indicates the level of the water, an automatic pyrometer and a valve in one lower part for draining.

The tank in its lower part communicates with a tube, which in turn has a pump, provided with valves one before and the other after the connection with the pump, and beginning with the second valve it communicates with a supply of fuel-oil. In turn the pump, by means of a valve, sends the water or fuel-oil to the bottom of the main tank, by a tube with lateral orifices, in such a way that the water circulates in a closed circuit, and when the pump cannot suck in water, it sucks in fuel-oil.

Fuel-oil heated to 90°C by the device described, is supplied to a pump which pumps it to a chamber which has electrical resistances which heat the fuel-oil to 300°C, from which chamber it passes to the mixing chamber via a register chamber. Into this mixing chamber there is also supplied water, pumped by a pump and which passes previously through a filter. Another filter is fitted in the fuel-oil supply line.

A fan meters the air for complete combustion, sending it to the mixing chamber through the interior of the burner housing structure.

Behind this mixing chamber is disposed a small pilot burner with an air inlet, regulation of the inlet by its entrance into the injector causing the atomization, an injection pump for the fuel-oil, electrodes for lighting and photo-electric cells for cancelling the operation in the event of malfunction of the pilot burner.

The flame of this pilot burner passes through the chamber in which the tubes for fuel-oil and water are located, and which eventually open into the mixing chamber.

BRIEF DESCRIPTION OF THE DRAWINGS

In order to explain the characteristics of the burners and gasifiers which illustrate the operation of this invention, accompanying Figures show an embodiment of an apparatus for performing the invention, provided as one convenient example, whilst variations in detail of presentation or arrangement may be made which do not affect the essentials concerning the burners and gasifiers of water vapour and hydrocarbons.

In the drawings.

DETAILED DESCRIPTION OF THE INVENTION

Figure 1:
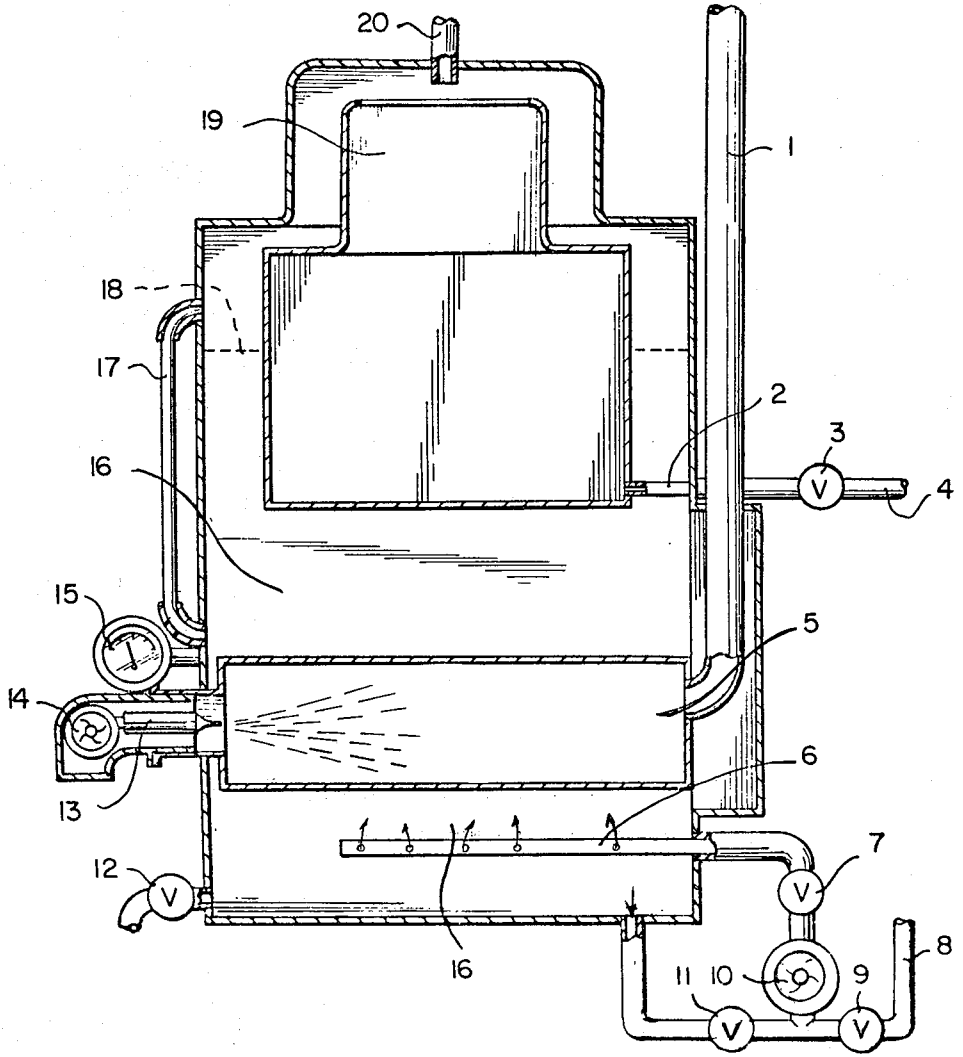
FIG. 1 shows schematically in elevation a device for filtering and preheating the fuel-oil.

The device shown in FIG. 1 comprises a tank 16, which contains water up to the level indicated at 18, which can be seen in a transparent tube 17. The water is heated to 90°C by a combustion chamber 5, which contains a burner comprising a pump 14 and atomizer 13. The combustion chamber 5 has a gas outlet flue 1. The temperature of the water is controlled by an automatic thermometer 15, which includes an electrical contact breaker which acts on the burner pump 14.

With the help of a pump 10, the water circulates in a closed circuit through tubes which pass through a valve 11 to the pump 10, and from there to the tank 16 via a tube 6 provided with a valve 7.

When the pump 10 is working at full capacity, the water applied to it is cut off little by little, until the pump cannot suck in all the water which it requires; the remainder of the intake is then provided by fuel-oil, which enters through a tube 8 and is controlled by a valve 9.

The hot water and the fuel-oil is formed into a mixture of finely divided particles by the pump 10, and as the mixture enters the interior of the tank, the fuel-oil, because of its lower density, rises to the upper part of the tank, separating completely from the water and leaving behind in the water all small particles or droplets which tend to accompany liquid fuels and which form a real problem in the majority of cases in which heavy fuel-oil is employed.

Figure 2:
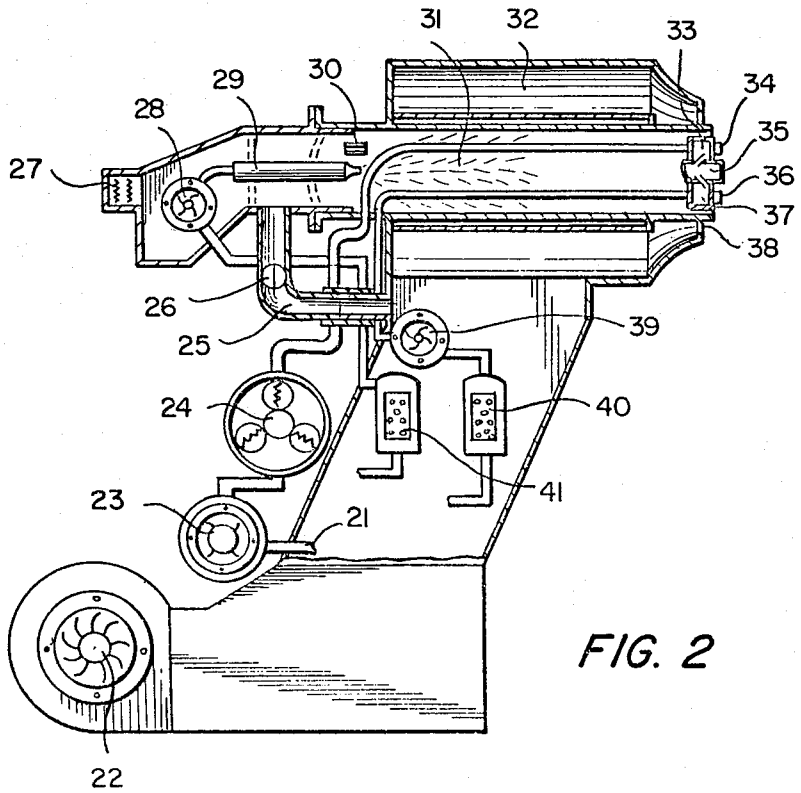
FIG. 2, also in schematic side elevation, shows a burner connected to the device of FIG. 1.

In the upper part of the tank 16 is located an open-topped container 19, in which is collected the filtered fuel-oil, part of which passes to the burner of FIG. 2 through tubes 2 and 4 (FIG. 1). The rest of the fuel-oil passes through an overflow outlet 20.

The valve 12, (FIG. 1) is for the purpose of draining the tank 16 if the level of water exceeds the suitable value.

The fuel-oil (heated to 90°C and free from particles and pockets of water) passes to the burner shown in FIG. 2, enters a pump 23 through a tube 21. The pump 23 controls the pressure in a chamber 24 containing three electrical resistance heating elements which heat the fuel-oil up to a temperature of around 300°C before it finally passes to a combustion chamber 35 via a register chamber 33.

Water is also supplied under pressure to the combustion chamber 35 via a register chamber 37 by a pump 39, being filtered by filter 40.

The burner of FIG. 2 is provided with a small pilot burner which has a photo-electric cell 27 to cut out its operation in the event of bad lighting. The pilot burner comprises a pump 28 for the injection of fuel-oil for burning, an air inlet 25, which passes through a throttle-valve regulator 26, and an injector 29 causing atomization in a chamber 31. A filter 41 is fitted in the fuel-oil supply for the pump 28. The lighting of this burner is effected by means of an electric spark between two electrodes 30.

The flame of the pilot burner passes through the chamber 31, in which the tubes for fuel-oil and water are located, and which at its end houses the chamber where the combustion of fuel and water takes place. Once the pilot flame has been established, the pumps 39, 23 for the water and fuel-oil are started up, and in the chamber 35 combustion takes place.

Figure 4:
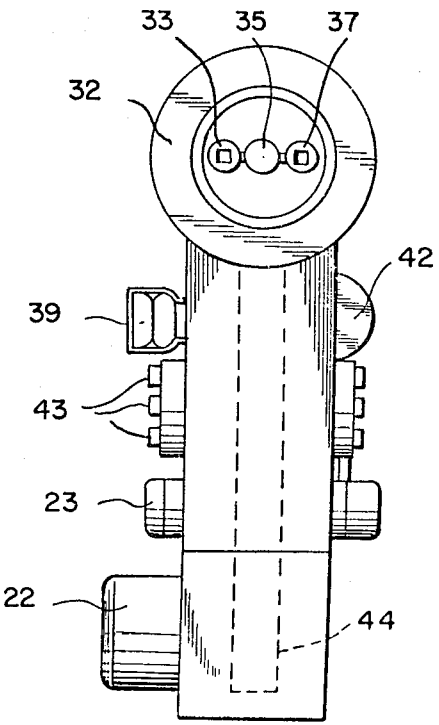

The air necessary for complete combustion is provided by a fan 22 (FIG. 2) and is supplied to a chamber 32, surround the chamber 31, through a duct 44 (FIG. 4). The air leaves at 38.

The chambers 33 and 37 have known type bungs or valve members 34 and 36 for registration, and possible for stopping leaks which restrict the flow of water and fuel-oil to the chamber 35.

Figure 3:
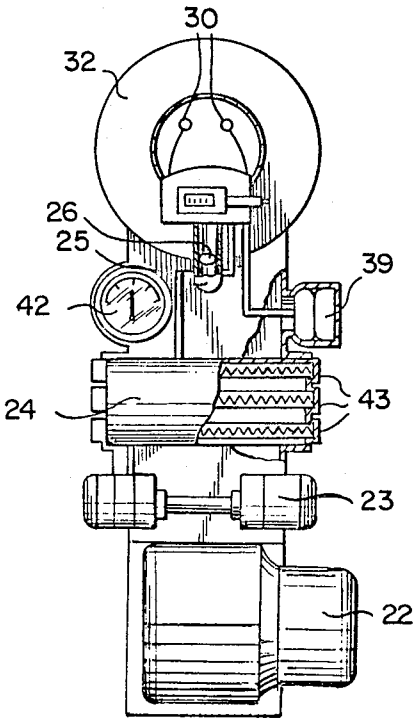
FIGS. 3 and 4 respectively show the back and front of the burner.

In FIG. 3 the electrical resistance heating elements 43 and the thermometer 42, for controlling the temperature of the fuel-oil at 300°C, are shown.

The arrangement described above has as its main advantages the following:

- Ease of starting, without blow-back.
- Quietness.
- No vibrating or off-centre components.
- Reliable combustion.
- Large variety of calorific values producible. It includes of course domestic burners for heating, up to kilns for making glass, in which the flame temperature reaches 1,500° to 1,550°C.
- Ease of changing any parts, so that maintenance is economic and rapid.
- — Compactness.
- —— — burn residual fuel of low quality in combination with waste water.
- Minimum production of oxides of sulphur, of nitrogen, of free hydrocarbons, pyrenes, etc..
- Great economy and complete collaboration in fighting against contamination of the ambient atmosphere.
- Conservation of equipment by reducing corrosion at low temperatures.
- Because of the characteristics of the combustion which takes place in the arrangement described, this can have the following applications.
- Through its enormous calorific capacity, it solves problems in the glass industry, the cement industry and the rest, and for silicates.

— Essential application for desalinization of sea water, making sea water drinkable, reclamation of brine.

— In order to eliminate waste domestic water, contributing to the cleanliness of the environment.

— In order to eliminate industrial waste water. (Paper plants, distilleries, electro-plating works, textile works and in those industries where the spillage of waste water constitutes a problem, due to its containing toxic products, or simply contaminents).

— Plants producing steam.

— Production of hot water, especially for comfort, or for industrial uses, enabling it to be approved in this last case for the elimination of water contaminated by industrial processes (electro-plating baths).

— Incineration of waste in any kind of plant, such as slaughter houses, clinics, or hospitals.

— Automobile industry.

— Industrial kilns, for laminating, drying, etc., exploiting its exceptional qualities for reducing or eliminating problems of superficial oxidation crusts on the parts concerned.

— Chemical industry, using the aspects of generation of heat and decontamination of residues, both accompanied as well as separated.

— In whatever occasion in which heat is specified or which leads to the elimination of waste, water charged with waste which is dissolved or in suspension.

I claim:

1. A method of burning fuel-oil comprising the steps of:

injecting fuel-oil into a tank partly filled with hot water maintained at approximately 90°C;

allowing the fuel-oil to rise through the hot water to form a separate layer of fuel-oil in the top of said tank while preheating said fuel-oil to a temperature of approximately 90°C;

withdrawing fuel-oil from said layer;

heating the thus withdrawn fuel-oil to a temperature of approximately 300°C;

injecting the heated fuel-oil into an open-ended mixing chamber of a combustion chamber while simultaneously injecting into said mixing chamber a separate jet of water so that an intimate mixture of fuel-oil and water is formed; and supplying to the open end of said mixing chamber sufficient air to support combustion of the said mixture.

2. A method as claimed in claim 1, further comprising withdrawing hot water from said tank, returning said withdrawn water to said tank through a conduit, and introducing fuel-oil into said conduit, whereby the thus introduced fuel-oil is drawn into the tank.

3. A method as claimed in claim 1, further comprising freeing said fuel-oil from particles and pockets of water while allowing said fuel-oil to rise through said hot water.

4. A method of burning fuel-oil comprising:

preheating fuel-oil to approximately 90°C while freeing said fuel-oil from particles and pockets of water;

passing the preheated fuel-oil, free from particles and pockets of water, to a burner assembly;

heating said fuel-oil in said burner assembly to approximately 300°C; and ejecting the hot fuel-oil from said assembly simultaneously with a separate jet of water which mixes with the fuel-oil.

* * * * *